US010132006B2

(12) United States Patent
Klein et al.

(10) Patent No.: US 10,132,006 B2
(45) Date of Patent: Nov. 20, 2018

(54) UHMWPE FIBER AND METHOD TO PRODUCE

(71) Applicant: Honeywell International Inc., Morristown, NJ (US)

(72) Inventors: Ralf Klein, Midlothian, VA (US); Henry Gerard Ardiff, Chesterfield, VA (US); John Armstrong Young, Midlothian, VA (US); Thomas Tam, Chesterfield, VA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 1261 days.

(21) Appl. No.: 13/795,278

(22) Filed: Mar. 12, 2013

(65) Prior Publication Data

US 2014/0065913 A1 Mar. 6, 2014

Related U.S. Application Data

(60) Provisional application No. 61/676,409, filed on Jul. 27, 2012.

(51) Int. Cl.
*D01D 10/00* (2006.01)
*D02G 3/36* (2006.01)
(Continued)

(52) U.S. Cl.
CPC ..... *D01D 10/00* (2013.01); *D02G 3/36* (2013.01); *D04H 3/007* (2013.01); *D06B 1/00* (2013.01); *D06L 1/12* (2013.01); *D06M 10/025* (2013.01); *D06M 15/00* (2013.01); *D06M 15/572* (2013.01); *D06M 15/693* (2013.01); *D06M 15/70* (2013.01); *D06M 2101/20* (2013.01); *Y10T 442/607* (2015.04)

(58) Field of Classification Search
None
See application file for complete search history.

(56) References Cited

U.S. PATENT DOCUMENTS 4,091,855 A 5/1978 Sibilia et al.
4,413,110 A 11/1983 Kavesh et al.
(Continued)

FOREIGN PATENT DOCUMENTS

CN 101532239 A 9/2009
EP 198565 10/1986
(Continued)

OTHER PUBLICATIONS

Bahadur et al. (Principles of Polymer Science, Alpha Science International Limited, pp. 209, 2005).*
(Continued)

*Primary Examiner* — Shawn Mckinnon
(74) *Attorney, Agent, or Firm* — Roberts & Roberts, LLP; Richard S. Roberts, Jr.

(57) ABSTRACT

Processes for preparing ultra-high molecular weight polyethylene yarns, and the yarns and articles produced therefrom. The surfaces of partially oriented yarns are subjected to a treatment that enhances the surface energy at the fiber surfaces and are coated with a protective coating immediately after the treatment to increase the shelf life of the treatment. The coated, treated yarns are then post drawn to form highly oriented yarns.

20 Claims, 1 Drawing Sheet

(51) Int. Cl.

| | |
|---|---|
| ***D04H 3/007*** | (2012.01) |
| ***D06B 1/00*** | (2006.01) |
| ***D06L 1/12*** | (2006.01) |
| ***D06M 15/693*** | (2006.01) |
| ***D06M 15/00*** | (2006.01) |
| ***D06M 15/572*** | (2006.01) |
| ***D06M 15/70*** | (2006.01) |
| ***D06M 10/02*** | (2006.01) |
| *D06M 101/20* | (2006.01) |

(56) References Cited

U.S. PATENT DOCUMENTS

| | | | | |
|---|---|---|---|---|
| 4,563,392 | A * | 1/1986 | Harpell | D06M 15/227 428/373 |
| 5,001,008 | A * | 3/1991 | Tokita | D01F 6/04 428/364 |
| 5,032,338 | A | 7/1991 | Weedon et al. | |
| 5,075,904 | A | 12/1991 | Shirasaki et al. | |
| 5,108,780 | A * | 4/1992 | Pitt | B29B 15/08 118/50.1 |
| 5,139,873 | A | 8/1992 | Rebouillat | |
| 5,183,701 | A | 2/1993 | Jacobs et al. | |
| 5,221,432 | A | 6/1993 | Choe et al. | |
| 5,421,378 | A * | 6/1995 | Bowers | B60R 21/235 139/100 |
| 5,582,644 | A * | 12/1996 | Gaddis | D04H 1/58 118/303 |
| 5,702,657 | A | 12/1997 | Yoshida et al. | |
| 6,007,584 | A * | 12/1999 | Suzuki | C11D 1/83 510/347 |
| 6,268,301 | B1 * | 7/2001 | Dalman | C08G 75/32 428/911 |
| 6,291,594 | B1 * | 9/2001 | Rodrigues | D06M 15/233 525/327.6 |
| 6,607,859 | B1 | 8/2003 | Tanaka et al. | |
| 7,935,283 | B2 | 5/2011 | Tam et al. | |
| 7,964,518 | B1 * | 6/2011 | Bhatnagar | B32B 5/26 2/2.5 |
| 8,022,171 | B2 | 9/2011 | Goossens et al. | |
| 8,057,897 | B2 | 11/2011 | Tam et al. | |
| 8,080,486 | B1 | 12/2011 | Bhatnagar et al. | |
| 8,969,221 | B2 | 3/2015 | Arvidson et al. | |
| 9,023,450 | B2 | 5/2015 | Tam et al. | |
| 9,023,451 | B2 | 5/2015 | Tam et al. | |
| 9,023,452 | B2 | 5/2015 | Tam et al. | |
| 9,163,335 | B2 | 10/2015 | Tam et al. | |
| 9,168,719 | B2 | 10/2015 | Tam et al. | |
| 2003/0033655 | A1 | 2/2003 | Kavesh | |
| 2003/0049985 | A1 | 3/2003 | Pinton et al. | |
| 2003/0199215 | A1 | 10/2003 | Bhatnagar et al. | |
| 2004/0023580 | A1 | 2/2004 | Hand et al. | |
| 2004/0077517 | A1 | 4/2004 | Boeckh et al. | |
| 2005/0093200 | A1 | 5/2005 | Tam et al. | |
| 2006/0012069 | A1 | 1/2006 | Smit et al. | |
| 2007/0172594 | A1 | 7/2007 | Sauer et al. | |
| 2008/0305331 | A1 | 12/2008 | Tam et al. | |
| 2009/0093180 | A1 | 4/2009 | Park et al. | |
| 2009/0115099 | A1 | 5/2009 | Goossens et al. | |
| 2009/0163105 | A1 | 6/2009 | Ardiff et al. | |
| 2009/0282596 | A1 | 11/2009 | Carbajal et al. | |
| 2009/0305038 | A1 | 12/2009 | Duran et al. | |
| 2010/0048076 | A1 | 2/2010 | Creyghton et al. | |
| 2010/0173156 | A1 | 7/2010 | Morin | |
| 2010/0204427 | A1 * | 8/2010 | Ren | D01F 6/46 526/352 |
| 2011/0045293 | A1 | 2/2011 | Tam et al. | |
| 2011/0191928 | A1 * | 8/2011 | Ardiff | D06M 15/01 2/2.5 |
| 2011/0245399 | A1 * | 10/2011 | Pajerski | C08F 283/008 524/457 |
| 2011/0266710 | A1 | 11/2011 | Tam et al. | |
| 2011/0268967 | A1 | 11/2011 | Tam et al. | |
| 2011/0269359 | A1 | 11/2011 | Tam et al. | |
| 2012/0004358 | A1 | 1/2012 | Tam et al. | |

FOREIGN PATENT DOCUMENTS

| | | |
|---|---|---|
| EP | 0311197 | 4/1989 |
| EP | 1818433 | 8/2007 |
| GB | 1477416 | 6/1977 |
| JP | S62161841 | 7/1987 |
| JP | H01-260060 | 10/1989 |
| JP | H06-158568 | 6/1994 |
| JP | 2001262469 | 9/2001 |
| JP | 2005179840 | 7/2005 |
| TW | 201104026 | 2/2011 |
| TW | I339224 | 3/2011 |
| WO | 93/00389 | 1/1993 |
| WO | WO2009108498 * | 9/2009 |

OTHER PUBLICATIONS

International Search Report and Written Opinion for Corresponding Patent Application PCT/US2013/050590.

Yim et al. "Interfacial shear strength studies of plasma-treated ultra-high molecular weight polyethylene fibers." AIChE 100—2008, AIChE Annual Meeting, Conference Proceedings, 2008 Nov. 16-21, 2008.

Bhatnagar, "Lightweight Ballistic Composites," Woodhead Publishing Limited, England, pp. 282-283 (2006).

Zhang et al., "Effects of Air Plasma Treatment on Tribological Properties of Hybrid PTFE/Kevlar Fabric Composite," Journal of Applied Polymer Science, vol. 114, pp. 3980-3986 (Aug. 19, 2009).

Du Pont Kevlar, Innovative Performance Solutions.

Bajaj, Pushpa; "Finishing of Textile Materials," Journal of Applied Polymer Science, vol. 83, pp. 139-169 (2001).

Gao et al.; "Surface Modification of Ultrahigh Molecular Weight Polyethylene Fiber by Plasma Treatment," Journal of Applied Polymer Science, vol. 47, pp. 2065-2071 (1993).

Zheng et al.; "Chemical Modification Combined With Corona Treatment of UHMWPE Fibers and Their Adhesion to Vinylester Resin," Journal of Adhesion Science Technology, vol. 20, No. 10, pp. 1047-1059 (2006).

Horrocks et al.; The Handbook of Technical Textiles ; p. 60 (2000).

Wang et al.; "Surface Modification of Ultra High Modulus Polyethylene Fibers by an Atmospheric Pressure Plasma Jet," Journal of Applied Polymer Science, vol. 108; pp. 25-33 (2007).

* cited by examiner

UHMWPE FIBER AND METHOD TO PRODUCE

CROSS-REFERENCE TO RELATED APPLICATION

This application claims the benefit of U.S. Provisional Application Ser. No. 61/676,409, filed on Jul. 27, 2012, the disclosure of which is incorporated by reference herein in its entirety.

BACKGROUND OF THE INVENTION

Field of the Invention

This invention relates to processes for preparing ultra-high molecular weight polyethylene ("UHMW PE") yarns, and the yarns and articles produced therefrom.

Description of the Related Art

Ballistic resistant articles fabricated from composites comprising high strength synthetic fibers are well known. Many types of high strength fibers are known, and each type of fiber has its own unique characteristics and properties. In this regard, one defining characteristic of a fiber is the ability of the fiber to bond with or adhere with surface coatings, such as resin coatings. For example, ultra-high molecular weight polyethylene fibers are naturally inert, while aramid fibers have a high-energy surface containing polar functional groups. Accordingly, resins generally exhibit a stronger affinity for aramid fibers compared to inert UHMW PE fibers. Nevertheless, it is also generally known that synthetic fibers are naturally prone to static build-up and thus typically require the application of a fiber surface finish in order to facilitate further processing into useful composites.

Fiber finishes are employed to reduce static build-up, and in the case of untwisted and un-entangled fibers, to aid in maintaining fiber cohesiveness and preventing fiber tangling. Finishes also lubricate the surface of the fiber, protecting the fiber from the equipment and protecting the equipment from the fiber.

The art teaches many types of fiber surface finishes for use in various industries. See, for example, U.S. Pat. Nos. 5,275,625, 5,443,896, 5,478,648, 5,520,705, 5,674,615, 6,365,065, 6,426,142, 6,712,988, 6,770,231, 6,908,579 and 7,021,349, which teach spin finish compositions for spun fibers. However, typical fiber surface finishes are not universally desirable. One notable reason is because a fiber surface finish can interfere with the interfacial adhesion or bonding of polymeric binder materials on fiber surfaces, including aramid fiber surfaces. Strong adhesion of polymeric binder materials is important in the manufacture of ballistic resistant fabrics, especially non-woven composites such as non-woven SPECTRA SHIELD® composites produced by Honeywell International Inc. of Morristown, N.J. Insufficient adhesion of polymeric binder materials on the fiber surfaces may reduce fiber-fiber bond strength and fiber-binder bond strength and thereby cause united fibers to disengage from each other and/or cause the binder to delaminate from the fiber surfaces. A similar adherence problem is also recognized when attempting to apply protective polymeric compositions onto woven fabrics. This detrimentally affects the ballistic resistance properties (anti-ballistic performance) of such composites and can result in catastrophic product failure.

It is known from application Ser. Nos. 61/531,233; 61/531,255; 61/531,268; 61/531,302; 61/531,323; 61/566,295 and 61/566,320, each of which is incorporated by reference herein, that the bond strength of an applied material on a fiber is improved when it is bonded directly with the fiber surfaces rather than being applied on top of a fiber finish. Such direct application is enabled by at least partially removing the pre-existing fiber surface finish from the fibers prior to applying the material, such as a polymeric binder material, onto the fibers and prior to uniting the fibers as fiber layers or fabrics.

It is also known from the above co-pending applications that the fiber surfaces may be treated with various surface treatments, such as a plasma treatment or a corona treatment, to enhance the surface energy at the fiber surfaces and thereby enhance the ability of a material to bond to the fiber surface. The surface treatments are particularly effective when performed directly on exposed fiber surfaces rather than on top of a fiber finish. The combined finish removal and surface treatment reduces the tendency of the fibers to delaminate from each other and/or delaminate from fiber surface coatings when employed within a ballistic resistant composite. However, the effects of such surface treatments are known to have a shelf life. Over time, the added surface energy decays and the treated surface eventually returns to its original dyne level. This decay of the treatment is particularly significant when treated fibers are not immediately fabricated into composites, but rather are stored for future use. Therefore, there is a need in the art for a method of preserving the surface treatment and thereby increasing the shelf life of the treated fibers.

SUMMARY OF THE INVENTION

The invention provides a process comprising:

a) providing one or more partially oriented fibers, each of said partially oriented fibers having surfaces that are substantially covered by a fiber surface finish;

b) removing at least a portion of the fiber surface finish from the fiber surfaces to at least partially expose the underlying fiber surfaces;

c) treating the exposed fiber surfaces under conditions effective to enhance the surface energy of the fiber surfaces;

d) applying a protective coating onto at least a portion of the treated fiber surfaces to thereby form coated, treated fibers; and e) passing the coated, treated fibers through one or more dryers to dry the coating on the coated, treated fibers while simultaneously stretching the coated, treated fibers as they travel through the one or more dryers, thereby forming highly oriented fibers having a tenacity of greater than 27 g/denier.

The invention also provides a process comprising:

a) providing one or more partially oriented fibers, each of said partially oriented fibers having at least some exposed surface areas that are at least partially free of a fiber surface finish;

b) treating the exposed fiber surfaces under conditions effective to enhance the surface energy of the fiber surfaces;

c) applying a protective coating onto at least a portion of the treated fiber surfaces to thereby form coated, treated fibers; and d) passing the coated, treated fibers through one or more dryers to dry the coating on the coated, treated fibers while simultaneously stretching the coated, treated fibers as they travel through the one or more dryers, thereby forming highly oriented fibers having a tenacity of greater than 27 g/denier.

The invention further provides a process comprising:

a) providing one or more treated partially oriented fibers, wherein said partially oriented fibers have a tenacity of at least about 18 g/denier up to about 27 g/denier, and wherein the surfaces of said treated partially oriented fibers have been treated under conditions effective to enhance the surface energy of the fiber surfaces;

b) applying a protective coating onto at least a portion of the treated fiber surfaces to thereby form coated, treated fibers, wherein the protective coating is applied onto the treated fiber surfaces immediately after the treatment that enhances the surface energy of the fiber surfaces; and c) passing the coated, treated fibers through one or more dryers to dry the coating on the coated, treated fibers while simultaneously stretching the coated, treated fibers as they travel through the one or more dryers, thereby forming highly oriented fibers having a tenacity of greater than 27 g/denier.

Also provided are fibrous composites produced from said processes.

DETAILED DESCRIPTION OF THE INVENTION

Figure 1:
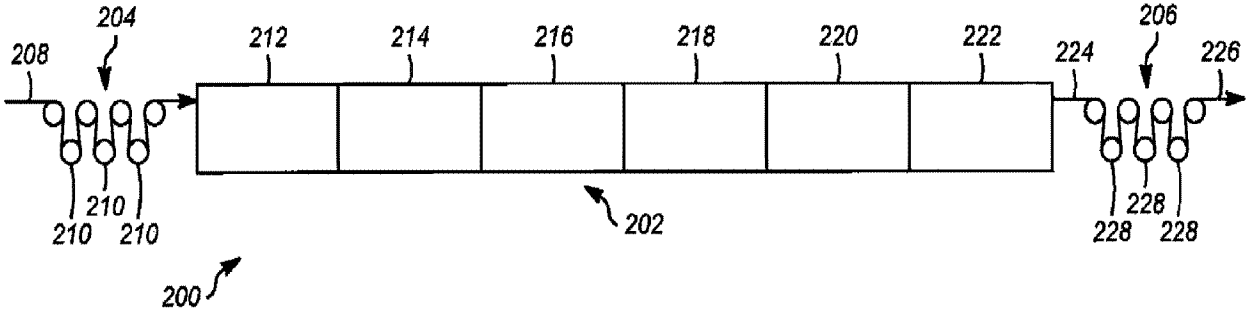
FIG. 1 illustrates an example of a post draw process utilizing a heating apparatus incorporating a series of horizontally arranged ovens with draw rolls external to the ovens.

A process is provided for treating and coating partially oriented fibers which are subsequently drawn to produce highly oriented fibers. As used herein, "partially oriented" fibers, alternatively referred to as partially oriented yarns, are fibers (or yarns) that have been subjected to one or more drawing steps which have resulted in the fabrication of fibers having a tenacity of at least about 18 g/denier up to about 27 g/denier. A desirable process for producing highly oriented fibers from partially oriented fibers is described in commonly-owned U.S. patent application publications 2011/0266710 and 2011/0269359, which are incorporated herein by reference to the extent consistent herewith. As described in said publications, a "partially oriented" fiber (alternatively "partially oriented yarn") is distinguished from a "highly oriented" fiber (yarn) in that a highly oriented fiber is produced from a partially oriented fiber, subjecting the partially oriented fiber to a post-drawing operation to thereby increase its fiber tenacity. In the context of the present invention, a highly oriented fiber (yarn) has a fiber tenacity of greater than 27 g/denier. As used herein, the term "tenacity" refers to the tensile stress expressed as force (grams) per unit linear density (denier) of an unstressed specimen and is measured by ASTM D2256. The "initial modulus" of a fiber is the property of a material representative of its resistance to deformation. The term "tensile modulus" refers to the ratio of the change in tenacity, expressed in grams-force per denier (g/d) to the change in strain, expressed as a fraction of the original fiber length (in/in).

In accordance with the present invention, a process is provided where partially oriented fibers are first treated to remove at least a portion of a fiber surface finish from the fiber surfaces to at least partially expose the underlying fiber surfaces, followed by treating the exposed fiber surfaces fibers to under conditions effective to enhance the surface energy of the fiber surfaces, followed by coating the treated fibers with a protective coating. After the protective coating is applied, the coated, treated fibers are subjected to a post-drawing operation where the fibers are drawn concurrently with the drying of the protective coating to form a highly oriented fiber.

To further define the invention, a "fiber" is an elongate body the length dimension of which is much greater than the transverse dimensions of width and thickness.

The cross-sections of fibers for use in this invention may vary widely, and they may be circular, flat or oblong in cross-section. Thus the term "fiber" includes filaments, ribbons, strips and the like having regular or irregular cross-section, but it is preferred that the fibers have a substantially circular cross-section. As used herein, the term "yarn" is defined as a single strand consisting of multiple fibers. A single fiber may be formed from just one filament or from multiple filaments. A fiber formed from just one filament is referred to herein as either a "single-filament" fiber or a "monofilament" fiber, and a fiber formed from a plurality of filaments is referred to herein as a "multifilament" fiber.

A fiber surface finish is typically applied to all fibers to facilitate their processability. To permit direct plasma or corona treatment of the fiber surfaces, it is necessary that existing fiber surface finishes be at least partially removed from the fiber surfaces, and preferably substantially completely removed from all or some of the fiber surfaces of some or all of the component fibers that will form a fibrous composite. This removal of the fiber finish will also serve to enhance fiber-fiber friction and to permit direct bonding of resins or polymeric binder materials to the fiber surfaces, thereby increasing the fiber-coating bond strength.

The step of washing the fibers or otherwise removing the fiber finish will remove enough of the fiber finish so that at least some of the underlying fiber surface is exposed, although different removal conditions should be expected to remove different amounts of the finish. For example, factors such as the composition of the washing agent (e.g. water), mechanical attributes of the washing technique (e.g. the force of the water contacting the fiber; agitation of a washing bath, etc.), will affect the amount of finish that is removed. For the purposes herein, minimal processing to achieve minimal removal of the fiber finish will generally expose at least 10% of the fiber surface area. Preferably, the fiber surface finish is removed such that the fibers are predominantly free of a fiber surface finish. As used herein, fibers that are "predominantly free" of a fiber surface finish are fibers which have had at least 50% by weight of their finish removed, more preferably at least about 75% by weight of their finish removed. It is even more preferred that the fibers are substantially free of a fiber surface finish. Fibers that are "substantially free" of a fiber finish are fibers which have had at least about 90% by weight of their finish removed, and most preferably at least about 95% by weight of their finish removed, thereby exposing at least about 90% or at least about 95% of the fiber surface area that was previously covered by the fiber surface finish. Most preferably, any residual finish will be present in an amount of less than or equal to about 0.5% by weight based on the weight of the fiber plus the weight of the finish, preferably less than or equal to about 0.4% by weight, more preferably less than or equal to about 0.3% by weight, more preferably less than or equal to about 0.2% by weight and most preferably less than or equal to about 0.1% by weight based on the weight of the fiber plus the weight of the finish.

Depending on the surface tension of the fiber finish composition, a finish may exhibit a tendency to distribute itself over the fiber surface, even if a substantial amount of the finish is removed. Thus, a fiber that is predominantly free of a fiber surface finish may still have a portion of its surface area covered by a very thin coating of the fiber finish. However, this remaining fiber finish will typically exist as residual patches of finish rather than a continuous coating. Accordingly, a fiber having surfaces that are predominantly free of a fiber surface finish preferably has its surface at least partially exposed and not covered by a fiber finish, where preferably less than 50% of the fiber surface area is covered by a fiber surface finish. Where removal of the fiber finish has resulted in less than 50% of the fiber surface area being covered by a fiber surface finish, the protective coating material will thereby be in direct contact with greater than 50% of the fiber surface area.

It is most preferred that the fiber surface finish is substantially completely removed from the fibers and the fiber surfaces are substantially completely exposed. In this regard, a substantially complete removal of the fiber surface finish is the removal of at least about 95%, more preferably at least about 97.5% and most preferably at least about 99.0% removal of the fiber surface finish, and whereby the fiber surface is at least about 95% exposed, more preferably at least about 97.5% exposed and most preferably at least about 99.0% exposed. Ideally, 100% of the fiber surface finish is removed, thereby exposing 100% of the fiber surface area. Following removal of the fiber surface finish, it is also preferred that the fibers are cleared of any removed finish particles prior to application of a polymeric binder material, resin or other adsorbate onto the exposed fiber surfaces. As processing of the fibers to achieve minimal removal of the fiber finish will generally expose at least about 10% of the fiber surface area, a comparable fiber which has not been similarly washed or treated to remove at least a portion of the fiber finish will have less than 10% of the fiber surface area exposed, with zero percent surface exposure or substantially no fiber surface exposure.

Any conventionally known method for removing fiber surface finishes is useful within the context of the present invention, including both mechanical and chemical techniques means. The necessary method is generally dependent on the composition of the finish. For example, in the preferred embodiment of the invention, the fibers are coated with a finish that is capable of being washed off with only water. Typically, a fiber finish will comprise a combination of one or more lubricants, one or more non-ionic emulsifiers (surfactants), one or more anti-static agents, one or more wetting and cohesive agents, and one or more antimicrobial compounds. The finish formulations preferred herein can be washed off with only water. Mechanical means may also be employed together with a chemical agent to improve the efficiency of the chemical removal. For example, the efficiency of finish removal using de-ionized water may be enhanced by manipulating the force, direction velocity, etc. of the water application process.

Most preferably, the fibers are washed and/or rinsed with water, preferably using de-ionized water, with optional drying of the fibers after washing, without using any other chemicals. In other embodiments where the finish is not water soluble, the finish may be removed or washed off with, for example, an abrasive cleaner, chemical cleaner or enzyme cleaner. For example, U.S. Pat. Nos. 5,573,850 and 5,601,775, which are incorporated herein by reference, teach passing yarns through a bath containing a non-ionic surfactant (HOSTAPUR® CX, commercially available from Clariant Corporation of Charlotte, N.C.), trisodium phosphate and sodium hydroxide, followed by rinsing the fibers. Other useful chemical agents non-exclusively include alcohols, such as methanol, ethanol and 2-propanol; aliphatic and aromatic hydrocarbons such as cyclohexane and toluene; chlorinated solvents such as di-chloromethane and tri-chloromethane. Washing the fibers will also remove any other surface contaminants, allowing for more intimate contact between the fiber and resin or other coating material.

The preferred means used to clean the fibers with water is not intended to be limiting except for the ability to substantially remove the fiber surface finish from the fibers. In a preferred method, removal of the finish is accomplished by a process that comprises passing a web or continuous array of generally parallel fibers through pressurized water nozzles to wash (or rinse) and/or physically remove the finish from the fibers. The fibers may optionally be presoaked in a water bath before passing the fibers through said pressurized water nozzles, and/or soaked after passing the fibers through the pressurized water nozzles, and may also optionally be rinsed after any of said optional soaking steps by passing the fibers through additional pressurized water nozzles. The washed/soaked/rinsed fibers are preferably also dried after washing/soaking/rinsing is completed. The equipment and means used for washing the fibers is not intended to be limiting, except that it must be capable of washing individual multifilament fibers/multifilament yarns rather than fabrics, i.e. before they are woven or formed into non-woven fiber layers or plies.

After the fiber surface finish is removed to the desired degree (and dried, if necessary), the fibers are subjected to a treatment that is effective to enhance the surface energy of the fiber surfaces. Useful treatments non-exclusively include corona treatment, plasma treatment, ozone treatment, acid etching, ultraviolet (UV) light treatment or any other treatment that is capable of aging or decaying over time. It has also been recognized that applying a protective coating onto fibers after removal of the fiber surface finish is beneficial to fibers even if they have not been subsequently treated or if the exposed fiber surfaces are treated with a treatment that does not alter fiber surface energy. This is because it is generally known that synthetic fibers are naturally prone to static build-up and need some form of lubrication to maintain fiber cohesiveness. The protective coating provides sufficient lubrication to the surface of the fiber, thereby protecting the fiber from the equipment and protecting the equipment from the fiber. It also reduces static build-up and facilitates further processing into useful composites. Accordingly, fiber surface treatments that do not alter fiber surface energy and have no risk of treatment decay are also within the scope of the invention, as the protective coating has numerous benefits.

Most preferably, however, the fibers are treated with a treatment effective to enhance the surface energy of the fiber surfaces, and the most preferred treatments are plasma treatment and corona treatment. Both a plasma treatment and a corona treatment will modify the fibers at the fiber surfaces, thereby enhancing the bonding of a subsequently applied protective coating onto the fiber surfaces. Removal of the fiber finish allows these additional processes to act directly on the surface of the fiber and not on the fiber surface finish or on surface contaminants. Plasma treatment and corona treatment are each particularly desirable for optimizing the interaction between the bulk fiber and fiber surface coatings to improve the anchorage of the protective coating and later applied polymeric/resinous binder (polymeric/resinous matrix) coatings to the fiber surfaces.

Corona treatment is a process in which fibers, typically in a web or in a continuous array of fibers, are passed through a corona discharge station, thereby passing the fibers through a series of high voltage electric discharges that enhance the surface energy of the fiber surfaces. In addition to enhancing the surface energy of the fiber surfaces, a corona treatment may also pit and roughen the fiber surface, such as by burning small pits or holes into the surface of the fiber, and may also introduce polar functional groups to the surface by way of partially oxidizing the surface of the fiber. When the corona treated fibers are oxidizable, the extent of oxidation is dependent on factors such as power, voltage and frequency of the corona treatment. Residence time within the corona discharge field is also a factor, and this can be manipulated by corona treater design or by the line speed of the process. Suitable corona treatment units are available, for example, from Enercon Industries Corp., Menomonee Falls, Wis., from Sherman Treaters Ltd, Thame, Oxon, UK, or from Softal Corona & Plasma GmbH & Co of Hamburg, Germany.

In a preferred embodiment, the fibers are subjected to a corona treatment of from about 2 Watts/ft$^2$/min to about 100 Watts/ft$^2$/min, more preferably from about 5 Watts/ft$^2$/min to about 50 Watts/ft$^2$/min, and most preferably from about 20 Watts/ft$^2$/min to about 50 Watts/ft$^2$/min. Lower energy corona treatments from about 1 Watts/ft$^2$/min to about 5 Watts/ft$^2$/min are also useful but may be less effective.

In a plasma treatment, fibers are passed through an ionized atmosphere in a chamber that is filled with an inert or non-inert gas, such as oxygen, argon, helium, ammonia, or another appropriate inert or non-inert gas, including combinations of the above gases, to thereby contact the fibers with a combination of neutral molecules, ions, free radicals, as well as ultraviolet light. At the fiber surfaces, collisions of the surfaces with charged particles (ions) result in both the transfer of kinetic energy and the exchange of electrons, etc., thereby enhancing the surface energy of the fiber surfaces. Collisions between the surfaces and free radicals will result in similar chemical rearrangements. Chemical changes to the fiber substrate are also caused by bombardment of the fiber surface by ultraviolet light which is emitted by excited atoms, and by molecules relaxing to lower states. As a result of these interactions, the plasma treatment may modify both the chemical structure of the fiber as well as the topography of the fiber surfaces. For example, like corona treatment, a plasma treatment may also add polarity to the fiber surface and/or oxidize fiber surface moieties. Plasma treatment may also serve to reduce the contact angle of the fiber, increase the crosslink density of the fiber surface thereby increasing hardness, melting point and the mass anchorage of subsequent coatings, and may add a chemical functionality to the fiber surface and potentially ablate the fiber surface. These effects are likewise dependent on the fiber chemistry, and are also dependent on the type of plasma employed.

The selection of gas is important for the desired surface treatment because the chemical structure of the surface is modified differently using different plasma gases. Such would be determined by one skilled in the art. It is known, for example, that amine functionalities may be introduced to a fiber surface using ammonia plasma, while carboxyl and hydroxyl groups may be introduced by using oxygen plasma. Accordingly, the reactive atmosphere may comprise one or more of argon, helium, oxygen, nitrogen, ammonia, and/or other gas known to be suitable for plasma treating of fabrics. The reactive atmosphere may comprise one or more of these gases in atomic, ionic, molecular or free radical form. For example, in a preferred continuous process of the invention, a web or a continuous array of fibers is passed through a controlled reactive atmosphere that preferably comprises argon atoms, oxygen molecules, argon ions, oxygen ions, oxygen free radicals, as well as other trace species. In a preferred embodiment, the reactive atmosphere comprises both argon and oxygen at concentrations of from about 90% to about 95% argon and from about 5% to about 10% oxygen, with 90/10 or 95/5 concentrations of argon/oxygen being preferred. In another preferred embodiment, the reactive atmosphere comprises both helium and oxygen at concentrations of from about 90% to about 95% helium and from about 5% to about 10% oxygen, with 90/10 or 95/5 concentrations of helium/oxygen being preferred. Another useful reactive atmosphere is a zero gas atmosphere, i.e. room air comprising about 79% nitrogen, about 20% oxygen and small amounts of other gases, which is also useful for corona treatment to some extent.

A plasma treatment differs from a corona treatment mainly in that a plasma treatment is conducted in a controlled, reactive atmosphere of gases, whereas in corona treatment the reactive atmosphere is air. The atmosphere in the plasma treater can be easily controlled and maintained, allowing surface polarity to be achieved in a more controllable and flexible manner than corona treating. The electric discharge is by radio frequency (RF) energy which dissociates the gas into electrons, ions, free radicals and metastable products. Electrons and free radicals created in the plasma collide with the fiber surface, rupturing covalent bonds and creating free radicals on the fiber surface. In a batch process, after a predetermined reaction time or temperature, the process gas and RF energy are turned off and the leftover gases and other byproducts are removed. In a continuous process, which is preferred herein, a web or a continuous array of fibers is passed through a controlled reactive atmosphere comprising atoms, molecules, ions and/or free radicals of the selected reactive gases, as well as other trace species. The reactive atmosphere is constantly generated and replenished, likely reaching a steady state composition, and is not turned off or quenched until the plasma machine is stopped.

Plasma treatment may be carried out using any useful commercially available plasma treating machine, such as plasma treating machines available from Softal Corona & Plasma GmbH & Co of Hamburg, Germany; 4$^{th}$ State, Inc of Belmont Calif.; Plasmatreat US LP of Elgin Ill.; Enercon Surface Treating Systems of Milwaukee, Wis. Plasma treating may be conducted in a chamber maintained under a vacuum or in a chamber maintained at atmospheric conditions. When atmospheric systems are used, a fully closed chamber is not mandatory. Plasma treating or corona treating the fibers in a non-vacuum environment, i.e. in a chamber that is not maintained at either a full or partial vacuum, may increase the potential for fiber degradation. This is because the concentration of the reactive species is proportional to the treatment pressure. This increased potential for fiber degradation may be countered by reducing the residence time in the treatment chamber. Treating fibers under a vacuum results in the need for long treatment residence times. This undesirably causes a typical loss of fiber strength properties, such as fiber tenacity, of approximately 15% to 20%. The aggressiveness of the treatments may be reduced by reducing energy flux of the treatment, but this sacrifices the effectiveness of the treatments in enhancing bonding of coatings on the fibers. However, when conducting the fiber treatments after at least partially removing the fiber finish, fiber tenacity loss is less than 5%, typically less than 2% or less than 1%, often no loss at all, and in some instances fiber strength properties actually increase, which is due to increased cros slink density of the polymeric fiber due to the direct treatment of the fiber surfaces. When conducting the fiber treatments after at least partially removing the fiber finish, the treatments are much more effective and may be conducted in less aggressive, non-vacuum environments at various levels of energy flux without sacrificing coating bond enhancement. In the most preferred embodiments of the invention, the high tenacity fibers are subjected to a plasma treatment or to a corona treatment in a chamber maintained at about atmospheric pressure or above atmospheric pressure. As a secondary benefit, plasma treatment under atmospheric pressure allows the treatment of more than one fiber at a time, whereas treatment under a vacuum is limited to the treatment of one fiber at a time.

A preferred plasma treating process is conducted at about atmospheric pressure, i.e. 1 atm (760 mm Hg (760 torr)), with a chamber temperature of about room temperature (70° F.-72° F.). The temperature inside the plasma chamber may potentially change due to the treating process, but the temperature is generally not independently cooled or heated during treatments, and it is not believed to affect the treatment of the fibers as they rapidly pass through the plasma treater. The temperature between the plasma electrodes and the fiber web is typically approximately 100° C. The plasma treating process is conducted within a plasma treater that preferably has a controllable RF power setting. Useful RF power settings are generally dependent on the dimensions of the plasma treater and therefore will vary. The power from the plasma treater is distributed over the width of the plasma treating zone (or the length of the electrodes) and this power is also distributed over the length of the substrate or fiber web at a rate that is inversely proportional to the line speed at which the fiber web passes through the reactive atmosphere of the plasma treater. This energy per unit area per unit time (watts per square foot per minute or $W/ft^2/min$) or energy flux, is a useful way to compare treatment levels. Effective values for energy flux are preferably from about 0.5 $W/ft^2/min$ to about 200 $W/ft^2/min$, more preferably from about 1 $W/ft^2/min$ to about 100 $W/ft^2/min$, even more preferably from about 1 $W/ft^2/min$ to about 80 $W/ft^2/min$, even more preferably from about 2 $W/ft^2/min$ to about 40 $W/ft^2/min$, and most preferably from about 2 $W/ft^2/min$ to about 20 $W/ft^2/min$.

As an example, when utilizing a plasma treater having a relatively narrow treating zone of 30-inches (76.2 cm) set at atmospheric pressure, the plasma treating process is preferably conducted at an RF power setting of from about 0.5 kW to about 3.5 kW, more preferably from about 1.0 kW to about 3.05 kW, and most preferably is conducted with RF power set at 2.0 kW. The total gas flow rate for a plasma treater of this size is preferably approximately 16 liters/min, but this is not intended to be strictly limiting. Larger plasma treating units are capable of higher RF power settings, such as 10 kW, 12 kW or even greater, and at higher gas flow rates relative to smaller plasma treaters.

As the total gas flow rate is distributed over the width of the plasma treating zone, additional gas flow may be necessary with increases to the length/width of the plasma treating zone of the plasma treater. For example, a plasma treater having a treating zone width of 2× may need twice as much gas flow compared to a plasma treater having a treating zone width of 1×. The plasma treatment time (or residence time) of the fiber is also is relative to the dimensions of the plasma treater employed and is not intended to be strictly limiting. In a preferred atmospheric system, the fibers are exposed to the plasma treatment with a residence time of from about ½ second to about three seconds, with an average residence time of approximately 2 seconds. A more appropriate measure of this exposure is the amount of plasma treatment in terms of RF power applied to the fiber per unit area over time, also called the energy flux.

Following the treatment that enhances the surface energy of the fiber surfaces, a protective coating is applied onto at least a portion of the treated fiber surfaces to thereby form coated, treated fibers. Coating the treated fiber surfaces immediately after the surface treatment is most preferred because it will cause the least disruption to the fiber manufacturing process and will leave the fiber in a modified and unprotected state for the shortest period of time. More importantly, because it is known that surface energy enhancing treatments decay or age over time and the fibers eventually return to their untreated, original surface energy level, applying a polymer or resin coating onto the treated fibers after the surface treatment has been found effective to preserve the enhanced energy level resulting from the fiber treatments. Most preferably, the protective coating is applied onto at least a portion of the treated fiber surfaces immediately after the treatment that enhances the surface energy of the fiber surfaces to leave the fibers in a treated and uncoated state for the shortest length of time to minimize surface energy decay.

A protective coating may be any solid, liquid or gas, including any monomer, oligomer, polymer or resin, and any organic or inorganic polymers and resins.

The protective coating may comprise any polymer or resin that is traditionally used in the art of ballistic resistant composites as a polymeric matrix or polymeric binder material, but the protective coating is applied to individual fibers, not to fabric layers or fiber plies, and is applied in small quantities, i.e. less than about 5% by weight based on the weight of the fiber plus the weight of the protective coating. More preferably, the protective coating comprises about 3% by weight or less based on the weight of the fiber plus the weight of the protective coating, still more preferably about 2.5% by weight or less, still more preferably about 2.0% by weight or less, still more preferably about 1.5% by weight or less, and most preferably the protective coating comprises about 1.0% by weight or less based on the weight of the fiber plus the weight of the protective coating.

Suitable protective coating polymers non-exclusively include both low modulus, elastomeric materials and high modulus, rigid materials, but most preferably the protective coating comprises a thermoplastic polymer, particularly a low modulus elastomeric material. For the purposes of this invention, a low modulus elastomeric material has a tensile modulus measured at about 6,000 psi (41.4 MPa) or less according to ASTM D638 testing procedures. A low modulus elastomeric material preferably has a tensile modulus of about 4,000 psi (27.6 MPa) or less, more preferably about 2400 psi (16.5 MPa) or less, still more preferably 1200 psi (8.23 MPa) or less, and most preferably is about 500 psi (3.45 MPa) or less. The glass transition temperature (Tg) of the elastomer is preferably less than about 0° C., more preferably the less than about −40° C., and most preferably less than about −50° C. A low modulus elastomeric material also has a preferred elongation to break of at least about 50%, more preferably at least about 100% and most preferably has an elongation to break of at least about 300%.

Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, fluoroelastomers, silicone elastomers, copolymers of ethylene, polyamides (useful with some fiber types), acrylonitrile butadiene styrene, polycarbonates, and combinations thereof, as well as other low modulus polymers and copolymers curable below the melting point of the fiber. Also preferred are blends of different elastomeric materials, or blends of elastomeric materials with one or more thermoplastics.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type $R-(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. Also useful are resin dispersions of styrene-isoprene-styrene (SIS) block copolymer sold under the trademark PRINLIN® and commercially available from Henkel Technologies, based in Düsseldorf, Germany. Particularly preferred low modulus polymeric binder polymers comprise styrenic block copolymers sold under the trademark KRATON® commercially produced by Kraton Polymers. A particularly preferred polymeric binder material comprises a polystyrene-polyisoprene-polystyrene-block copolymer sold under the trademark KRATON®.

Also particularly preferred are acrylic polymers and acrylic copolymers. Acrylic polymers and copolymers are preferred because their straight carbon backbone provides hydrolytic stability. Acrylic polymers are also preferred because of the wide range of physical properties available in commercially produced materials. Preferred acrylic polymers non-exclusively include acrylic acid esters, particularly acrylic acid esters derived from monomers such as methyl acrylate, ethyl acrylate, n-propyl acrylate, 2-propyl acrylate, n-butyl acrylate, 2-butyl acrylate and tert-butyl acrylate, hexyl acrylate, octyl acrylate and 2-ethylhexyl acrylate. Preferred acrylic polymers also particularly include methacrylic acid esters derived from monomers such as methyl methacrylate, ethyl methacrylate, n-propyl methacrylate, 2-propyl methacrylate, n-butyl methacrylate, 2-butyl methacrylate, tert-butyl methacrylate, hexyl methacrylate, octyl methacrylate and 2-ethylhexyl methacrylate. Copolymers and terpolymers made from any of these constituent monomers are also preferred, along with those also incorporating acrylamide, n-methylol acrylamide, acrylonitrile, methacrylonitrile, acrylic acid and maleic anhydride. Also suitable are modified acrylic polymers modified with non-acrylic monomers. For example, acrylic copolymers and acrylic terpolymers incorporating suitable vinyl monomers such as: (a) olefins, including ethylene, propylene and isobutylene; (b) styrene, N-vinylpyrrolidone and vinylpyridine; (c) vinyl ethers, including vinyl methyl ether, vinyl ethyl ether and vinyl n-butyl ether; (d) vinyl esters of aliphatic carboxylic acids, including vinyl acetate, vinyl propionate, vinyl butyrate, vinyl laurate and vinyl decanoates; and (f) vinyl halides, including vinyl chloride, vinylidene chloride, ethylene dichloride and propenyl chloride. Vinyl monomers which are likewise suitable are maleic acid diesters and fumaric acid diesters, in particular of monohydric alkanols having 2 to 10 carbon atoms, preferably 3 to 8 carbon atoms, including dibutyl maleate, dihexyl maleate, dioctyl maleate, dibutyl fumarate, dihexyl fumarate and dioctyl fumarate.

Most specifically preferred are polar resins or polar polymer, particularly polyurethanes within the range of both soft and rigid materials at a tensile modulus ranging from about 2,000 psi (13.79 MPa) to about 8,000 psi (55.16 MPa). Preferred polyurethanes are applied as aqueous polyurethane dispersions that are most preferably co-solvent free. Such includes aqueous anionic polyurethane dispersions, aqueous cationic polyurethane dispersions and aqueous nonionic polyurethane dispersions. Particularly preferred are aqueous anionic polyurethane dispersions, and most preferred are aqueous anionic, aliphatic polyurethane dispersions. Such includes aqueous anionic polyester-based polyurethane dispersions; aqueous aliphatic polyester-based polyurethane dispersions; and aqueous anionic, aliphatic polyester-based polyurethane dispersions, all of which are preferably cosolvent free dispersions. Such also includes aqueous anionic polyether polyurethane dispersions; aqueous aliphatic polyether-based polyurethane dispersions; and aqueous anionic, aliphatic polyether-based polyurethane dispersions, all of which are preferably cosolvent free dispersions. Similarly preferred are all corresponding variations (polyester-based; aliphatic polyester-based; polyether-based; aliphatic polyether-based, etc.) of aqueous cationic and aqueous nonionic dispersions. Most preferred is an aliphatic polyurethane dispersion having a modulus at 100% elongation of about 700 psi or more, with a particularly preferred range of 700 psi to about 3000 psi. More preferred are aliphatic polyurethane dispersions having a modulus at 100% elongation of about 1000 psi or more, and still more preferably about 1100 psi or more. Most preferred is an aliphatic, polyether-based anionic polyurethane dispersion having a modulus of 1000 psi or more, preferably 1100 psi or more.

The protective coating is applied directly onto the treated fiber surfaces using any appropriate method that would be readily determined by one skilled in the art and the term "coated" is not intended to limit the method by which it is applied onto the fibers. The method used must at least partially coat each treated fiber with the protective coating, preferably substantially coating or encapsulating each individual fiber thereby covering all or substantially all of the filament/fiber surface area with the protective coating. The protective coating may be applied either simultaneously or sequentially to a single fiber or to a plurality of fibers, where a plurality of fibers may be arranged side-by-side in an array and coated with the protective coating as an array.

The fibers treated herein are partially oriented fibers having a tenacity prior to plasma/corona treating of at least about 18 g/denier up to about 27 g/denier. As stated previously, partially oriented fibers/yarns have not been post drawn and thus have lower tenacity than highly oriented fibers/yarns which have been post drawn which increases the fiber/yarn tenacity to above 27 g/denier. For example, in a preferred processes for producing a gel spun yarn made from ultra high molecular weight polyethylene, a slurry comprising an UHMW PE and a spinning solvent is fed to an extruder to produce a liquid mixture, the liquid mixture is then passed through a heated vessel to form a homogeneous solution comprising the UHMW PE and the spinning solvent; that solution is then provided from the heated vessel to a spinneret to form a solution yarn; the solution yarn that issues from the spinneret is then drawn at a draw ratio of from about 1.1:1 to about 30:1 to form a drawn solution yarn; the drawn solution yarn is then cooled to a temperature below the gel point of the UHMW PE polymer to form a gel yarn; the gel yarn is then drawn one or more times in one or more stages; the spinning solvent is then removed from the gel yarn to form a dry yarn; and the dry yarn is then drawn in at least one stage to form a partially oriented yarn. This process is disclosed in greater detail in commonly-owned U.S. patent application publications 2011/0266710 and 2011/0269359.

The polymers forming the fibers are preferably high-strength, high tensile modulus fibers suitable for the manufacture of ballistic resistant composites/fabrics. Particularly suitable high-strength, high tensile modulus fiber materials that are particularly suitable for the formation of ballistic resistant composites and articles include polyolefin fibers, including high density and low density polyethylene. Particularly preferred are extended chain polyolefin fibers, such as highly oriented, high molecular weight polyethylene fibers, particularly ultra-high molecular weight polyethylene fibers, and polypropylene fibers, particularly ultra-high molecular weight polypropylene fibers. Also suitable are aramid fibers, particularly para-aramid fibers, polyamide fibers, polyethylene terephthalate fibers, polyethylene naphthalate fibers, extended chain polyvinyl alcohol fibers, extended chain polyacrylonitrile fibers, polybenzazole fibers, such as polybenzoxazole (PBO) and polybenzothiazole (PBT) fibers, liquid crystal copolyester fibers and rigid rod fibers such as M5® fibers. Each of these fiber types is conventionally known in the art. Also suitable for producing polymeric fibers are copolymers, block polymers and blends of the above materials.

The most preferred fiber types for ballistic resistant fabrics include polyethylene, particularly extended chain polyethylene fibers, aramid fibers, polybenzazole fibers, liquid crystal copolyester fibers, polypropylene fibers, particularly highly oriented extended chain polypropylene fibers, polyvinyl alcohol fibers, polyacrylonitrile fibers and rigid rod fibers, particularly M5® fibers. Specifically most preferred fibers are polyolefin fibers, particularly polyethylene and polypropylene fiber types.

In the case of polyethylene, preferred fibers are extended chain polyethylenes having molecular weights of at least 500,000, preferably at least one million and more preferably between two million and five million. Such extended chain polyethylene (ECPE) fibers may be grown in solution spinning processes such as described in U.S. Pat. No. 4,137,394 or 4,356,138, which are incorporated herein by reference, or may be spun from a solution to form a gel structure, such as described in U.S. Pat. Nos. 4,551,296 and 5,006,390, which are also incorporated herein by reference. A particularly preferred fiber type for use in the invention are polyethylene fibers sold under the trademark SPECTRA® from Honeywell International Inc. SPECTRA® fibers are well known in the art and are described, for example, in U.S. Pat. Nos. 4,413,110; 4,440,711; 4,535,027; 4,457,985; 4,623,547; 4,650,710 and 4,748,064, as well as co-pending application publications 2011/0266710 and 2011/0269359, all of which are incorporated herein by reference to the extent consistent herewith. In addition to polyethylene, another useful polyolefin fiber type is polypropylene (fibers or tapes), such as TEGRIS® fibers commercially available from Milliken & Company of Spartanburg, S.C.

Also particularly preferred are aramid (aromatic polyamide) or para-aramid fibers. Such are commercially available and are described, for example, in U.S. Pat. No. 3,671,542. For example, useful poly(p-phenylene terephthalamide) filaments are produced commercially by DuPont under the trademark of KEVLAR®. Also useful in the practice of this invention are poly(m-phenylene isophthalamide) fibers produced commercially by DuPont under the trademark NOMEX® and fibers produced commercially by Teijin under the trademark TWARON®; aramid fibers produced commercially by Kolon Industries, Inc. of Korea under the trademark HERACRON®; p-aramid fibers SVM™ and RUSAR™ which are produced commercially by Kamensk Volokno JSC of Russia and ARMOS™ p-aramid fibers produced commercially by JSC Chim Volokno of Russia.

Suitable polybenzazole fibers for the practice of this invention are commercially available and are disclosed for example in U.S. Pat. Nos. 5,286,833, 5,296,185, 5,356,584, 5,534,205 and 6,040,050, each of which is incorporated herein by reference. Suitable liquid crystal copolyester fibers for the practice of this invention are commercially available and are disclosed, for example, in U.S. Pat. Nos. 3,975,487; 4,118,372 and 4,161,470, each of which is incorporated herein by reference. Suitable polypropylene fibers include highly oriented extended chain polypropylene (ECPP) fibers as described in U.S. Pat. No. 4,413,110, which is incorporated herein by reference. Suitable polyvinyl alcohol (PVOH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and is widely commercially available.

M5® fibers are formed from pyridobisimidazole-2,6-diyl (2,5-dihydroxy-p-phenylene) and are manufactured by Magellan Systems International of Richmond, Va. and are described, for example, in U.S. Pat. Nos. 5,674,969, 5,939,553, 5,945,537, and 6,040,478, each of which is incorporated herein by reference. Also suitable are combinations of all the above materials, all of which are commercially available. For example, the fibrous layers may be formed from a combination of one or more of aramid fibers, UHMWPE fibers (e.g. SPECTRA® fibers), carbon fibers, etc., as well as fiberglass and other lower-performing materials. The process of the invention nevertheless is primarily suited for polyethylene and polypropylene fibers.

Once coated, the coated, treated, partially oriented fibers/yarns are then conveyed to a post drawing apparatus comprising one or more dryers where they are stretched/drawn again for their final conversion into highly oriented fibers/yarns while simultaneously the coating is dried on the fibers. The dryers are preferably forced convection air ovens maintained at a temperature of from about 125° C. to about 160° C. Preferably, the post drawing apparatus comprises a plurality of ovens arranged adjacent to each other in a horizontal series, or arranged vertically on top of each other, or a combination thereof. Other means for drying the coating may also be used, as would be determined by one skilled in the art.

The post drawing operation can, for example, include the conditions described in U.S. Pat. No. 6,969,553, U.S. Pat. No. 7,370,395 or in U.S. Published Application Serial No. 2005/0093200, each of which is incorporated herein in its entirety. One example of a post drawing process is illustrated in FIG. 1. A post drawing apparatus 200 as illustrated includes a heating apparatus 202, a first set of rolls 204 that are external to the heating apparatus 202, and a second set of rolls 206 that are external to the heating apparatus 202. The partially oriented fiber 208 can be fed from a source and passed over the first set of rolls 204. The first set of rolls 204 can be driven rolls, which are operated to rotate at a desired speed to provide the partially oriented fiber 208 to the heating apparatus 202 at a desired feed velocity. The first set of rolls 204 can include a plurality of individual rolls 210. In one example, the first few individual rolls 210 are not heated, and the remaining individual rolls 210 are heated in order to preheat the filaments of the partially oriented fiber 208 before it enters the heating apparatus 202. Although the first set of rolls 204 shown in FIG. 1 includes a total of seven individual rolls 210, the number of individual rolls 210 can be higher or lower, depending upon the desired configuration.

In the embodiment of FIG. 1, the partially oriented fiber 208 is fed into a heating apparatus 202 comprising six adjacent horizontal ovens 212, 214, 216, 218, 220 and 222, although any suitable number of ovens can be utilized, and each oven can each have any suitable length to provide the desired fiber path length. For example, each oven may be from about 10 feet to about 16 feet (3.05 meters to 4.88 meters) long, more preferably from about 11 feet to about 13 feet (3.35 meters to 3.96 meters) long. The temperature and speed of the partially oriented fiber 208 through the heating apparatus 202 can be varied as desired. For example, one or more temperature controlled zones may exist in the heating apparatus 202, with each zone having a temperature of from about 125° C. to about 160° C., more preferably from about 130° C. to about 160° C., or from about 150° C. to about 160° C. Preferably the temperature within a zone is controlled to vary less than ±2° C. (a total less than 4° C.), more preferably less than ±1° C. (a total less than 2° C.).

The path of the partially oriented fiber 208 in heating apparatus 202 can be an approximate straight line. The tension profile of the partially oriented fiber 208 during the post drawing process can be adjusted by adjusting the speed of the various rolls or by adjusting the temperature profile of the heating apparatus 202. For example, the tension of the partially oriented fiber 208 can be increased by increasing the difference between the speeds of consecutive driven rolls or decreasing the temperature in the heating apparatus 202. Preferably, the tension of the partially oriented fiber 208 in the heating apparatus 202 is approximately constant, or is increasing through the heating apparatus 202.

A heated fiber 224 exits the last oven 222 and can then be passed over the second set of rolls 206 to thereby form the finished highly oriented fiber product 226. The second set of rolls 206 can be driven rolls, which are operated to rotate at a desired speed to set the draw ratio for the coated partially oriented yarn and to remove the heated fiber 222 from the heating apparatus 202. The second set of rolls 206 can include a plurality of individual rolls 228. Although the second set of rolls 206 includes a total of seven individual rolls 228 as shown in FIG. 1, the number of individual rolls 228 can be higher or lower, depending upon the desired configuration. Additionally, the number of individual rolls 228 in the second set of rolls 206 can be the same as or different than the number of individual rolls 210 in the first set of rolls 204. Preferably, the second set of rolls 206 can be cold, so that the finished highly oriented fiber product 226 is cooled to a temperature below at least about 90° C. under tension to preserve its orientation and morphology.

Figure 2:
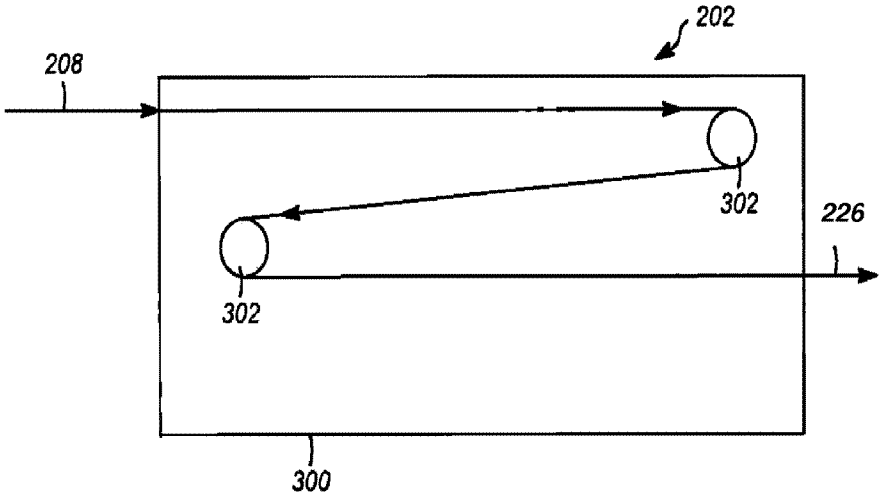
FIG. 2 illustrates an example of a post draw process utilizing a heating apparatus incorporating a single oven having internal draw rolls.

An alternative embodiment of the heating apparatus 202 is illustrated in FIG. 2. As shown in FIG. 2, the heating apparatus 202 can include one or more ovens, such as a single oven 300. Each oven is preferably a forced convection air oven having the same conditions as described above with reference to FIG. 1. The oven 300 can have any suitable length, and in one example can be from about 10 feet to about 20 feet (3.05 to 6.10 meters) long. The oven 300 can include one or more intermediate rolls 302, over which the partially oriented fiber 208 can be passed in the oven 300 to change its direction in order to increase the path of travel of the partially oriented fiber 208 within the heating apparatus 202. Each of the one or more intermediate rolls 302 can be a driven roll that rotates at a predetermined speed, or an idler roll that can rotate freely as the partially oriented fiber 208 passes over it. Additionally, each of the one or more intermediate rolls 302 can be located internal to the oven 300, as shown, or alternatively one or more intermediate rolls 302 can be located external to the oven 300. Utilization of the one or more intermediate rolls 302 increases the effective length of the heating apparatus 202. Any suitable number of intermediate rolls can be utilized in order to provide the desired total fiber path length. Exiting the heating apparatus 202 is a highly oriented fiber/yarn product 226.

In a preferred post drawing operation, post drawing is preferably conducted at a draw ratio of from about 1.8:1 to about 15:1, more preferably from about 2.5:1 to about 10:1, and most preferably at a draw ratio of from about 3.0:1 to about 4.5:1 to form a highly oriented yarn product having a tenacity of greater than about 27 g/denier. More preferably, the resulting highly oriented, coated, treated fibers have a tenacity of at least about 30 g/denier, still more preferably have a tenacity of at least about 37 g/denier, still more preferably have a tenacity of at least about 45 g/denier, still more preferably have a tenacity of at least about 50 g/denier, still more preferably have a tenacity of at least about 55 g/denier and most preferably have a tenacity of at least about 60 g/denier. All tenacity measurements identified herein are measured at ambient room temperature. As used herein, the term "denier" refers to the unit of linear density, equal to the mass in grams per 9000 meters of fiber or yarn. The process can include final steps of cooling the highly oriented fiber product without tension or under tension to form a cooled highly oriented fiber product produced, and winding up the cooled, coated, treated highly oriented fiber product thereby produced into a spool or package to be stored for later use. As a primary beneficial feature of this process, the coating applied to the fibers allows the fiber surfaces to remain in a treated, surface energy enhanced state as the fibers remain in storage awaiting use, such as fabrication in to a ballistic composite, thereby improving commercial scalability of the fiber treating process.

In alternate embodiments, the post drawing operation may be delayed, wherein the protective coating on the coated, treated, partially oriented fiber/yarn is dried or allowed to dry without immediate further stretching, or post drawing may be skipped altogether. In these embodiments, the coated, treated, partially oriented fibers/yarn is wound into a spool or package. This stored fiber/yarn may then be stored for later stretching into a highly oriented fiber/yarn via a post drawing operation as described above, or stored for later use as a coated, treated, partially oriented fiber/yarn having a tenacity of 27 g/denier or less. These embodiments, however, are not preferred.

The treated, highly oriented fibers produced according to the processes of the invention may be fabricated into woven and/or non-woven fibrous materials that have superior ballistic penetration resistance. For the purposes of the invention, articles that have superior ballistic penetration resistance describe those which exhibit excellent properties against deformable projectiles, such as bullets, and against penetration of fragments, such as shrapnel. A "fibrous" material is a material that is fabricated from fibers, filaments and/or yarns, wherein a "fabric" is a type of fibrous material.

A non-woven fabric is preferably formed by stacking one or more fiber plies of randomly oriented fibers (e.g. a felt or a mat) or unidirectionally aligned, parallel fibers, and then consolidating the stack to form a fiber layer. A "fiber layer" as used herein may comprise a single-ply of non-woven fibers or a plurality of non-woven fiber plies. A fiber layer may also comprise a woven fabric or a plurality of consolidated woven fabrics. A "layer" describes a generally planar arrangement having both an outer top surface and an outer bottom surface. A "single-ply" of unidirectionally oriented fibers comprises an arrangement of generally non-overlapping fibers that are aligned in a unidirectional, substantially parallel array, and is also known in the art as a "unitape", "unidirectional tape", "UD" or "UDT." As used herein, an "array" describes an orderly arrangement of fibers or yarns, which is exclusive of woven fabrics, and a "parallel array" describes an orderly parallel arrangement of fibers or yarns. The term "oriented" as used in the context of "oriented fibers" refers to the alignment of the fibers as opposed to stretching of the fibers.

As used herein, "consolidating" refers to combining a plurality of fiber layers into a single unitary structure, with our without the assistance of a polymeric binder material. Consolidation can occur via drying, cooling, heating, pressure or a combination thereof. Heat and/or pressure may not be necessary, as the fibers or fabric layers may just be glued together, as is the case in a wet lamination process. The term "composite" refers to combinations of fibers with at least one polymeric binder material.

As described herein, "non-woven" fabrics include all fabric structures that are not formed by weaving. For example, non-woven fabrics may comprise a plurality of unitapes that are at least partially coated with a polymeric binder material, stacked/overlapped and consolidated into a single-layer, monolithic element, as well as a felt or mat comprising non-parallel, randomly oriented fibers that are preferably coated with a polymeric binder composition.

Most typically, ballistic resistant composites formed from non-woven fabrics comprise fibers that are coated with or impregnated with a polymeric or resinous binder material, also commonly known in the art as a "polymeric matrix" material. These terms are conventionally known in the art and describe a material that binds fibers together either by way of its inherent adhesive characteristics or after being subjected to well known heat and/or pressure conditions. Such a "polymeric matrix" or "polymeric binder" material may also provide a fabric with other desirable properties, such as abrasion resistance and resistance to deleterious environmental conditions, so it may be desirable to coat the fibers with such a binder material even when its binding properties are not important, such as with woven fabrics.

The polymeric binder material partially or substantially coats the individual fibers of the fiber layers, preferably substantially coating or encapsulating each of the individual fibers/filaments of each fiber layer. Suitable polymeric binder materials include both low modulus materials and high modulus materials. Low modulus polymeric matrix binder materials generally have a tensile modulus of about 6,000 psi (41.4 MPa) or less according to ASTM D638 testing procedures and are typically employed for the fabrication of soft, flexible armor, such as ballistic resistant vests. High modulus materials generally have a higher initial tensile modulus than 6,000 psi and are typically employed for the fabrication of rigid, hard armor articles, such as helmets.

Preferred low modulus materials include all of those described above as useful for the protective coating. Preferred high modulus binder materials include polyurethanes (both ether and ester based), epoxies, polyacrylates, phenolic/polyvinyl butyral (PVB) polymers, vinyl ester polymers, styrene-butadiene block copolymers, as well as mixtures of polymers such as vinyl ester and diallyl phthalate or phenol formaldehyde and polyvinyl butyral. A particularly preferred rigid polymeric binder material for use in this invention is a thermosetting polymer, preferably soluble in carbon-carbon saturated solvents such as methyl ethyl ketone, and possessing a high tensile modulus when cured of at least about $1\times10^6$ psi (6895 MPa) as measured by ASTM D638. Particularly preferred rigid polymeric binder materials are those described in U.S. Pat. No. 6,642,159, the disclosure of which is incorporated herein by reference. The rigidity, impact and ballistic properties of the articles formed from the composites of the invention are affected by the tensile modulus of the polymeric binder polymer coating the fibers. The polymeric binder, whether a low modulus material or a high modulus material, may also include fillers such as carbon black or silica, may be extended with oils, or may be vulcanized by sulfur, peroxide, metal oxide or radiation cure systems as is well known in the art.

Similar to the protective coating, a polymeric binder may be applied either simultaneously or sequentially to a plurality of fibers arranged as a fiber web (e.g. a parallel array or a felt) to form a coated web, applied to a woven fabric to form a coated woven fabric, or as another arrangement, to thereby impregnate the fiber layers with the binder. As used herein, the term "impregnated with" is synonymous with "embedded in" as well as "coated with" or otherwise applied with the coating where the binder material diffuses into a fiber layer and is not simply on a surface of fiber layers. The polymeric binder material may be applied onto the entire surface area of the individual fibers or only onto a partial surface area of the fibers, but most preferably the polymeric binder material is applied onto substantially all the surface area of each individual fiber forming a fiber layer of the invention. Where a fiber layer comprises a plurality of yarns, each fiber forming a single strand of yarn is preferably coated with the polymeric binder material.

The polymeric material may also be applied onto at least one array of fibers that is not part of a fiber web, followed by weaving the fibers into a woven fabric or followed by formulating a non-woven fabric. Techniques of forming woven fabrics are well known in the art and any fabric weave may be used, such as plain weave, crowfoot weave, basket weave, satin weave, twill weave and the like. Plain weave is most common, where fibers are woven together in an orthogonal 0°/90° orientation. Also useful are 3D weaving methods wherein multi-layer woven structures are fabricated by weaving warp and weft threads both horizontally and vertically.

Techniques for forming non-woven fabrics are also well known in the art. In a typical process, a plurality of fibers are arranged into at least one array, typically being arranged as a fiber web comprising a plurality of fibers aligned in a substantially parallel, unidirectional array. The fibers are then coated with the binder material and the coated fibers are formed into non-woven fiber plies, i.e. unitapes. A plurality of these unitapes are then overlapped atop each other and consolidated into multi-ply, single-layer, monolithic element, most preferably wherein the parallel fibers of each single-ply are positioned orthogonally to the parallel fibers of each adjacent single-ply, relative to the longitudinal fiber direction of each ply. Although orthogonal)/90 fiber orientations are preferred, adjacent plies can be aligned at virtually any angle between about 0° and about 90° with respect to the longitudinal fiber direction of another ply. For example, a five ply non-woven structure may have plies oriented at a 0°/45°/90°/45°/0° or at other angles. Such rotated unidirectional alignments are described, for example, in U.S. Pat. Nos. 4,457,985; 4,748,064; 4,916,000; 4,403,012; 4,623,574; and 4,737,402, all of which are incorporated herein by reference to the extent not incompatible herewith.

This stack of overlapping, non-woven fiber plies is then consolidated under heat and pressure, or by adhering the coatings of individual fiber plies to each other to form a non-woven composite fabric. Most typically, non-woven fiber layers or fabrics include from 1 to about 6 adjoined fiber plies, but may include as many as about 10 to about 20 plies as may be desired for various applications. The greater the number of plies translates into greater ballistic resistance, but also greater weight.

Generally, a polymeric binder coating is necessary to efficiently merge, i.e. consolidate, a plurality of non-woven fiber plies. Coating woven fabrics with a polymeric binder material is preferred when it is desired to consolidate a plurality of stacked woven fabrics into a complex composite, but a stack of woven fabrics may be may be attached by other means as well, such as with a conventional adhesive layer or by stitching.

Methods of consolidating fiber plies to form fiber layers and composites are well known, such as by the methods described in U.S. Pat. No. 6,642,159. Consolidation can occur via drying, cooling, heating, pressure or a combination thereof. Heat and/or pressure may not be necessary, as the fibers or fabric layers may just be glued together, as is the case in a wet lamination process. Typically, consolidation is done by positioning the individual fiber plies on one another under conditions of sufficient heat and pressure to cause the plies to combine into a unitary fabric. Consolidation may be done at temperatures ranging from about 50° C. to about 175° C., preferably from about 105° C. to about 175° C., and at pressures ranging from about 5 psig (0.034 MPa) to about 2500 psig (17 MPa), for from about 0.01 seconds to about 24 hours, preferably from about 0.02 seconds to about 2 hours. When heating, it is possible that the polymeric binder coating can be caused to stick or flow without completely melting. However, generally, if the polymeric binder material is caused to melt, relatively little pressure is required to form the composite, while if the binder material is only heated to a sticking point, more pressure is typically required. As is conventionally known in the art, consolidation may be conducted in a calender set, a flat-bed laminator, a press or in an autoclave. Consolidation may also be conducted by vacuum molding the material in a mold that is placed under a vacuum. Vacuum molding technology is well known in the art. Most commonly, a plurality of orthogonal fiber webs are "glued" together with the binder polymer and run through a flat bed laminator to improve the uniformity and strength of the bond. Further, the consolidation and polymer application/bonding steps may comprise two separate steps or a single consolidation/lamination step.

Alternately, consolidation may be achieved by molding under heat and pressure in a suitable molding apparatus. Generally, molding is conducted at a pressure of from about 50 psi (344.7 kPa) to about 5,000 psi (34,470 kPa), more preferably about 100 psi (689.5 kPa) to about 3,000 psi (20,680 kPa), most preferably from about 150 psi (1,034 kPa) to about 1,500 psi (10,340 kPa). Molding may alternately be conducted at higher pressures of from about 5,000 psi (34,470 kPa) to about 15,000 psi (103,410 kPa), more preferably from about 750 psi (5,171 kPa) to about 5,000 psi, and more preferably from about 1,000 psi to about 5,000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. and most preferably at a temperature from about 200° F. to about 280° F. The pressure under which the fiber layers and fabric composites of the invention are molded has a direct effect on the stiffness or flexibility of the resulting molded product. Particularly, the higher the pressure at which they are molded, the higher the stiffness, and vice-versa. In addition to the molding pressure, the quantity, thickness and composition of the fiber plies and polymeric binder coating type also directly affects the stiffness of the articles formed from the composites.

While each of the molding and consolidation techniques described herein are similar, each process is different. Particularly, molding is a batch process and consolidation is a generally continuous process. Further, molding typically involves the use of a mold, such as a shaped mold or a match-die mold when forming a flat panel, and does not necessarily result in a planar product. Normally consolidation is done in a flat-bed laminator, a calendar nip set or as a wet lamination to produce soft (flexible) body armor fabrics. Molding is typically reserved for the manufacture of hard armor, e.g. rigid plates. In either process, suitable temperatures, pressures and times are generally dependent on the type of polymeric binder coating materials, polymeric binder content, process used and fiber type.

The fabrics/composites of the invention may also optionally comprise one or more thermoplastic polymer layers attached to one or both of its outer surfaces. Suitable polymers for the thermoplastic polymer layer non-exclusively include polyolefins, polyamides, polyesters (particularly polyethylene terephthalate (PET) and PET copolymers), polyurethanes, vinyl polymers, ethylene vinyl alcohol copolymers, ethylene octane copolymers, acrylonitrile copolymers, acrylic polymers, vinyl polymers, polycarbonates, polystyrenes, fluoropolymers and the like, as well as copolymers and mixtures thereof, including ethylene vinyl acetate (EVA) and ethylene acrylic acid. Also useful are natural and synthetic rubber polymers. Of these, polyolefin and polyamide layers are preferred. The preferred polyolefin is a polyethylene. Non-limiting examples of useful polyethylenes are low density polyethylene (LDPE), linear low density polyethylene (LLDPE), medium density polyethylene (MDPE), linear medium density polyethylene (LMDPE), linear very-low density polyethylene (VLDPE), linear ultra-low density polyethylene (ULDPE), high density polyethylene (HDPE) and co-polymers and mixtures thereof. Also useful are SPUNFAB® polyamide webs commercially available from Spunfab, Ltd, of Cuyahoga Falls, Ohio (trademark registered to Keuchel Associates, Inc.), as well as THERMOPLAST™ and HELIOPLAST™ webs, nets and films, commercially available from Protechnic S.A. of Cernay, France. Such a thermoplastic polymer layer may be bonded to the fabric/composite surfaces using well known techniques, such as thermal lamination. Typically, laminating is done by positioning the individual layers on one another under conditions of sufficient heat and pressure to cause the layers to combine into a unitary structure. Lamination may be conducted at temperatures ranging from about 95° C. to about 175° C., preferably from about 105° C. to about 175° C., at pressures ranging from about 5 psig (0.034 MPa) to about 100 psig (0.69 MPa), for from about 5 seconds to about 36 hours, preferably from about 30 seconds to about 24 hours. Such thermoplastic polymer layers may alternatively be bonded to said outer surfaces with hot glue or hot melt fibers as would be understood by one skilled in the art.

The thickness of the fabrics/composites will correspond to the thickness of the individual fibers/tapes and the number of fiber/tape plies or layers incorporated into the fabric/composite. For example, a preferred woven fabric will have a preferred thickness of from about 25 μm to about 600 μm per ply/layer, more preferably from about 50 μm to about 385 μm and most preferably from about 75 μm to about 255 μm per ply/layer. A preferred two-ply non-woven fabric will have a preferred thickness of from about 12 μm to about 600 μm, more preferably from about 50 μm to about 385 μm and most preferably from about 75 μm to about 255 μm. Any thermoplastic polymer layers are preferably very thin, having preferred layer thicknesses of from about 1 μm to about 250 μm, more preferably from about 5 μm to about 25 μm and most preferably from about 5 μm to about 9 μm. Discontinuous webs such as SPUNFAB® non-woven webs are preferably applied with a basis weight of 6 grams per square meter (gsm). While such thicknesses are preferred, it is to be understood that other thicknesses may be produced to satisfy a particular need and yet fall within the scope of the present invention.

To produce a fabric article having sufficient ballistic resistance properties, the total weight of the binder/matrix coating preferably comprises from about 2% to about 50% by weight, more preferably from about 5% to about 30%, more preferably from about 7% to about 20%, and most preferably from about 11% to about 16% by weight of the fibers plus the weight of the coating, wherein 16% is most preferred for non-woven fabrics. A lower binder/matrix content is appropriate for woven fabrics, wherein a polymeric binder content of greater than zero but less than 10% by weight of the fibers plus the weight of the coating is typically most preferred. This is not intended as limiting. For example, phenolic/PVB impregnated woven aramid fabrics are sometimes fabricated with a higher resin content of from about 20% to about 30%, although around 12% content is typically preferred.

The fabrics of the invention may be used in various applications to form a variety of different ballistic resistant articles using well known techniques, including flexible, soft armor articles as well as rigid, hard armor articles. For example, suitable techniques for forming ballistic resistant articles are described in, for example, U.S. Pat. Nos. 4,623,574, 4,650,710, 4,748,064, 5,552,208, 5,587,230, 6,642,159, 6,841,492 and 6,846,758, all of which are incorporated herein by reference to the extent not incompatible herewith. The composites are particularly useful for the formation of hard armor and shaped or unshaped sub-assembly intermediates formed in the process of fabricating hard armor articles. By "hard" armor is meant an article, such as helmets, panels for military vehicles, or protective shields, which have sufficient mechanical strength so that it maintains structural rigidity when subjected to a significant amount of stress and is capable of being freestanding without collapsing. Such hard articles are preferably, but not exclusively, formed using a high tensile modulus binder material.

The structures can be cut into a plurality of discrete sheets and stacked for formation into an article or they can be formed into a precursor which is subsequently used to form an article. Such techniques are well known in the art. In a most preferred embodiment of the invention, a plurality of fiber layers are provided, each comprising a consolidated plurality of fiber plies, wherein a thermoplastic polymer film is bonded to at least one outer surface of each fiber layer either before, during or after a consolidation step which consolidates the plurality of fiber plies, wherein the plurality of fiber layers are subsequently merged by another consolidation step which consolidates the plurality of fiber layers into an armor article or sub-assembly of an armor article.

As described in application Ser. Nos. 61/531,233; 61/531,255; 61/531,268; 61/531,302; and 61/531,323 which are identified above, there is a direct correlation between backface signature of a ballistic resistant composite and the tendency of the component fibers of a ballistic resistant composite to delaminate from each other and/or delaminate from fiber surface coatings as a result of a projectile impact. Backface signature, also known in the art as "backface deformation," "trauma signature" or "blunt force trauma," is the measure of the depth of deflection of body armor due to a bullet impact. When a bullet is stopped by composite armor, potentially resulting blunt trauma injuries may be as deadly to an individual as if the bullet had penetrated the armor and entered the body. This is especially consequential in the context of helmet armor, where the transient protrusion caused by a stopped bullet can still cross the plane of the wearer's skull and cause debilitating or fatal brain damage.

A treatment such as plasma or corona treatment improves the ability of coatings to adsorb to, adhere to or bond to the fiber surface, thereby reducing the tendency of fiber surface coatings to delaminate. The treatment accordingly has been found to reduce composite backface deformation upon a projectile impact, which is desirable. The protective coating described herein preserves the surface treatment so that it is not necessary to immediately fabricate the treated yarns into composites, but rather they may be stored for future use. Fibers treated according to the inventive process also remain processable despite removal of the yarn finish, and retain the fiber physical properties following treatment relative to untreated fibers.

The following examples serve to illustrate the invention.

Inventive Example 1

Four 3300 denier partially oriented UHMW PE yarns were unwound from four spools at a rate of 6.7 m/min and to washed to remove a pre-existing finish from the yarns. To wash the yarns, they were first directed through a pre-soak water bath containing de-ionized water with an approximate residence time in the bath was about 18 seconds. After exiting the pre-soak water bath, the yarns were rinsed with water nozzles at a water pressure of approximately 42 psi and with a water flow rate of approximately 0.5 gallons per minute per nozzle. The water temperature was measured as 28.9° C. The washed yarns were then dried and plasma treated. Plasma treatment was conducted by passing the yarns through an atmospheric plasma treater (model: Enercon Plasma3 Station Model APT12DF-150/2, from Enercon Industries Corp., having 29-inch wide electrodes) having an atmosphere comprising 90% argon & 10% oxygen at a rate of approximately 6 m/min. The plasma treater was set to a power of 2 kW, thereby treating the yarns with an energy flux of 54 watts/ft$^2$/min. The residence time of the yarns within the plasma treater was approximately 2 seconds. Treatment was conducted under standard atmospheric pressure. The plasma treated yarns were then coated with an aqueous anionic, aliphatic polyester-based polyurethane dispersion. The polyurethane coating weight was 2% based on the weight of the coating plus the weight of the yarn. The yarns were then conveyed into and through a heated oven having an oven temperature of 150° C., wherein the coated yarns were drawn at a draw ratio of 4.4 m/min to convert them into highly oriented yarns while simultaneously drying the polyurethane coating on the yarns. Each dried highly oriented yarn was then rewound on a new spool at a rate of 29.5 m/minute. The final denier, tensile modulus and tenacity of each highly oriented yarn were then measured. The average final denier of the highly oriented yarns was 754. The average final tensile modulus of each highly oriented yarn was 1551 g/denier, and the average final tenacity of each highly oriented yarn was 48.2 g/denier.

Comparative Example 1

Four 3300 denier partially oriented UHMW PE yarns were unwound from four fiber spools at a rate of 6.7 m/min as in Inventive Example 1. However, these yarns were not washed to remove their pre-existing finish nor were they plasma treated.

The yarns were then conveyed into and through a heated oven having an oven temperature of 150° C., wherein the (uncoated) yarns were drawn at a draw ratio of 4.4 m/min to convert them into highly oriented yarns. Each highly oriented yarn was then rewound on a new spool at a rate of 29.5 m/minute. The final denier, tensile modulus and tenacity of each highly oriented yarn were then measured. The average final denier of the highly oriented yarns was 737. The average final tensile modulus of each highly oriented yarn was 1551 g/denier, and the average final tenacity of each highly oriented yarn was 48.6 g/denier.

Conclusions

As shown by these examples, yarns treated and coated according to the inventive process have final physical properties that are approximately equivalent to the properties of yarns that are untreated. As a result of the yarn washing and plasma treatment, as well as the coating which protects the plasma treatment from decaying over time, it may be concluded that fibers which are treated and coated according to the inventive process may be stored for several weeks for future use and be expected to perform the same as fibers that are converted into ballistic resistant composite materials immediately after plasma treatment Such benefits are expected to include the improvement in backface signature, which is also known in the art as "backface deformation," "trauma signature" or "blunt force trauma," of composites formed therefrom. In addition to preserving these benefits of the treatment, the protective coating also improves fiber processability by preventing or reducing static buildup on the fiber surface, by enhancing fiber bundle cohesion and by providing good fiber lubrication.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A process comprising:

a) providing one or more partially oriented fibers, each of said partially oriented fibers having surfaces that are covered by a fiber surface finish;

b) washing the fibers to remove only a portion of the fiber surface finish from the fiber surfaces wherein a residual fiber surface finish remains on the fiber surfaces, wherein from 50% to 99.0% of the fiber surface area is exposed and not covered by the residual fiber surface finish;

c) corona treating or plasma treating the exposed fiber surfaces under conditions effective to enhance the surface energy of the fiber surfaces;

d) applying a protective coating onto at least a portion of the treated fiber surfaces on top of said residual fiber surface finish to thereby form coated, treated fibers; and e) passing the coated, treated fibers through one or more dryers to dry the protective coating on the coated, treated fibers while simultaneously stretching the coated, treated fibers as they travel through the one or more dryers, thereby forming highly oriented fibers having a tenacity of greater than 27 g/denier and having a dry protective coating thereon.

2. The process of claim 1 wherein said partially oriented fibers are polyethylene fibers having a tenacity of at least about 18 g/denier up to about 27 g/denier, and wherein the highly oriented fibers have a tenacity of at least about 45 g/denier, and wherein said fibers are fabricated into a ballistic resistant composite having improved backface deformation resistance.

3. The process of claim 1 wherein the protective coating comprises less than about 5% by weight based on the weight of the fiber plus the weight of the protective coating and wherein after step d) the protective coating is dried and thereafter a polymeric binder material is applied onto said fibers on top of the protective coating, wherein said polymeric binder material comprises from about 7% to about 20% by weight of the fibers plus the weight of the binder material.

4. The process of claim 1 wherein the protective coating is applied onto the treated fiber surfaces immediately after treating step c), wherein the protective coating is a polymer or resin and comprises less than about 3% by weight based on the weight of the fiber plus the weight of the protective coating, and wherein the protective coating is bonded to the fibers.

5. The process of claim 1 the partially oriented fibers are plasma treated with a plasma energy flux of about 100 $W/ft^2/min$ or less, or wherein the highly oriented fibers are corona treated with an energy of from about 2 $Watts/ft^2/min$ to about 100 $Watts/ft^2/min$.

6. The process of claim 1 wherein the protective coating comprises less than about 5% by weight based on the weight of the fiber plus the weight of the protective coating, and wherein the removal of only a portion of the fiber surface finish is accomplished by washing the fibers with water only without using any other chemicals, and wherein the finish is at least partially physically removed from the fibers by passing the fibers through pressurized water nozzles.

7. The process of claim 1 wherein the fibers comprise polyethylene fibers and wherein the removal of only a portion of the fiber surface finish is accomplished by washing the fibers with water only without using any other chemicals.

8. The process of claim 1 wherein the process further comprises winding the coated, treated fibers for storage after step e), and thereafter unwinding the fibers and producing a ballistic resistant woven fabric or non-woven fabric from said plurality of fibers and wherein a polymeric binder material is coated on top of the protective coating either before or after formation of the ballistic resistant woven fabric or non-woven fabric, and wherein said polymeric binder material comprises from about 7% to about 20% by weight of the fibers plus the weight of the binder material.

9. The process of claim 1 wherein the process comprises providing a plurality of highly oriented fibers produced in step e), each having a tenacity of at least 37 g/denier, applying a polymeric binder material onto at least a portion of said fibers on top of said protective coating, and producing a ballistic resistant woven fabric or non-woven fabric from said plurality of fibers.

10. A fibrous composite produced by the process of claim 9.

11. The process of claim 1 wherein the process comprises providing a plurality of coated, treated fibers produced in step d), applying a polymeric binder material onto at least a portion of said fibers on top of the protective coating, and producing a woven or non-woven fabric from said plurality of fibers.

12. A process comprising:

a) providing one or more partially oriented fibers, each of said partially oriented fibers having surfaces that are covered by a fiber surface finish;

b) washing the fibers to remove only a portion of the fiber surface finish from the fiber surfaces wherein a residual fiber surface finish remains on the fiber surfaces, wherein from 50% to 99.0% of the fiber surface area is exposed and not covered by the residual fiber surface finish;

c) treating the exposed fiber surfaces under conditions effective to enhance the surface energy of the fiber surfaces;

d) applying a protective coating onto at least a portion of the treated fiber surfaces on top of said residual fiber surface finish to thereby form coated, treated fibers; wherein the protective coating comprises less than about 5% by weight based on the weight of the fiber plus the weight of the protective coating and wherein the protective coating comprises a monomer; and e) passing the coated, treated fibers through one or more dryers to dry the coating on the coated, treated fibers while simultaneously stretching the coated, treated fibers as they travel through the one or more dryers, thereby forming highly oriented fibers having a tenacity of greater than 27 g/denier and having a dry protective coating thereon.

13. The process of claim 12 wherein the protective coating consists essentially of a monomer.

14. The process of claim 12 wherein the protective coating consists of a monomer, wherein the fibers are polyethylene fibers, and wherein the protective coating encapsulates the fibers and is bonded to the fiber surface.

15. The process of claim 1 wherein the protective coating consists essentially of an inorganic polymer.

16. The process of claim 1 wherein the protective coating consists of an inorganic polymer, wherein the fibers are polyethylene fibers, and wherein the protective coating encapsulates the fibers and is bonded to the fiber surface.

17. The process of claim 1 wherein the fibers are polyethylene fibers and the protective coating comprises an inorganic polymer.

18. A coated, treated fiber having a tenacity of greater than 27 g/denier, wherein the fiber has a fiber surface area that is partially covered by a residual fiber surface finish, said residual fiber surface finish covering from 1.0% to 50% of the fiber surface area, and further comprising a dry protective coating on the fibers on top of the residual fiber surface finish.

19. The coated, treated fiber of claim 18 wherein the protective coating comprises an inorganic polymer.

20. The coated, treated fiber of claim 18 wherein the protective coating comprises a monomer.

* * * * *